United States Patent [19]

Carney

[11] 4,004,263

[45] Jan. 18, 1977

[54] PROTECTOR MODULE FOR TELEPHONE SYSTEMS

[75] Inventor: William V. Carney, Valley Stream, N.Y.

[73] Assignee: Porta Systems Corporation, Syosset, N.Y.

[22] Filed: June 9, 1975

[21] Appl. No.: 584,768

[52] U.S. Cl. ..... 337/32; 317/66

[51] Int. Cl.[2] ..... H01H 39/00

[58] Field of Search ..... 337/28, 29, 31, 32; 317/15, 16, 71, 66

[56] References Cited

UNITED STATES PATENTS

| | | | |
|---|---|---|---|
| 3,743,888 | 7/1973 | Baumbach | 337/32 X |
| 3,818,271 | 6/1974 | Baumbach | 337/32 X |
| 3,849,750 | 11/1974 | Baumbach et al. | 337/32 |
| 3,886,411 | 5/1975 | Klayum | 337/32 X |

*Primary Examiner*—George Harris
*Attorney, Agent, or Firm*—Charles E. Temko

[57] ABSTRACT

An improved telephone line protection device including means for grounding excessive currents and voltages. The disclosed embodiments include temperature actuated resilient means for shorting currents directly to a source of ground potential without passing such currents through the elements normally present for protecting against excessive voltage surges, which are damaged by carrying excessive currents.

4 Claims, 2 Drawing Figures

FIG. 1

PROTECTOR MODULE FOR TELEPHONE SYSTEMS

BACKGROUND OF THE INVENTION

This invention relates generally to the field of telephone protection modules associated with individual telephone subscriber lines, for the joint purpose of shielding such lines from damage caused by the presence of excessive voltage or excessive currents which may result from contact with fallen power lines, incorrect connections with non-telephone circuits, and the like.

Depending upon the particular requirements of individual telephone systems, protector modules will normally include a pair of carbon blocks defining a gap over which excessive voltages may arc in the process of being conducted to ground potential. The carbon blocks are often combined with heat sensitive means responsive to the presence of excessive currents to permit a resilient means to short said currents through the carbon blocks to ground potential. Other types include a more recently developed gaseous discharge device, the outer surfaces of which are employed to conduct the currents to ground potential.

While such constructions offer protection to the particular subscriber line with which they are associated, the above described mode of operation often results in unnecessary damage to the module or the components thereof, whereby repair of the same for reuse is no longer practical. Where excessive currents are caused to arc through the carbon blocks or gaseous discharge device, the heat developed by such currents, often in the order of 100 amperes and more results in a welding action destroying both the casing of the module and the internal components thereof. Prior art devices have, in the past, been considered expendable, but the cost of manufacture of more recent sophisticated designs is no longer inconsequential.

SUMMARY OF THE INVENTION

Briefly stated, the invention contemplates the provision of improved protector modules of the above described type in which means is incorporated for the conduction of excess currents to ground potential by by-passing the components provided for the protection against excessive voltages, so that arcing of excess currents carrying heat of destructive proportions is avoided. Depending upon the elements present in the module, e.g. carbon blocks only, gaseous discharge tube, or carbon blocks in conjunction with a heat sensitive device, the establishment of direct connection to ground potential upon the occurrence of excessive currents is conveniently accomplished.

In the case of modules equipped with a heat-responsive device including a resiliently actuated conductive pin or shaft, there has been difficulty in obtaining a low resistance path of conduction owing to the difficulty of precisely fitting relatively moving parts. The invention further contemplates the establishment of supplemental conductive paths in such constructions, whereby the effective resistance to excessive current flow is reduced by at least an order of magnitude, and arcing is prevented in parts of the module other than the excessive voltage protective elements.

BRIEF DESCRIPTION OF THE DRAWING

In the drawing, to which reference will be made in the specification.

DETAILED DESCRIPTION OF THE DISCLOSED EMBODIMENT

Figure 1:
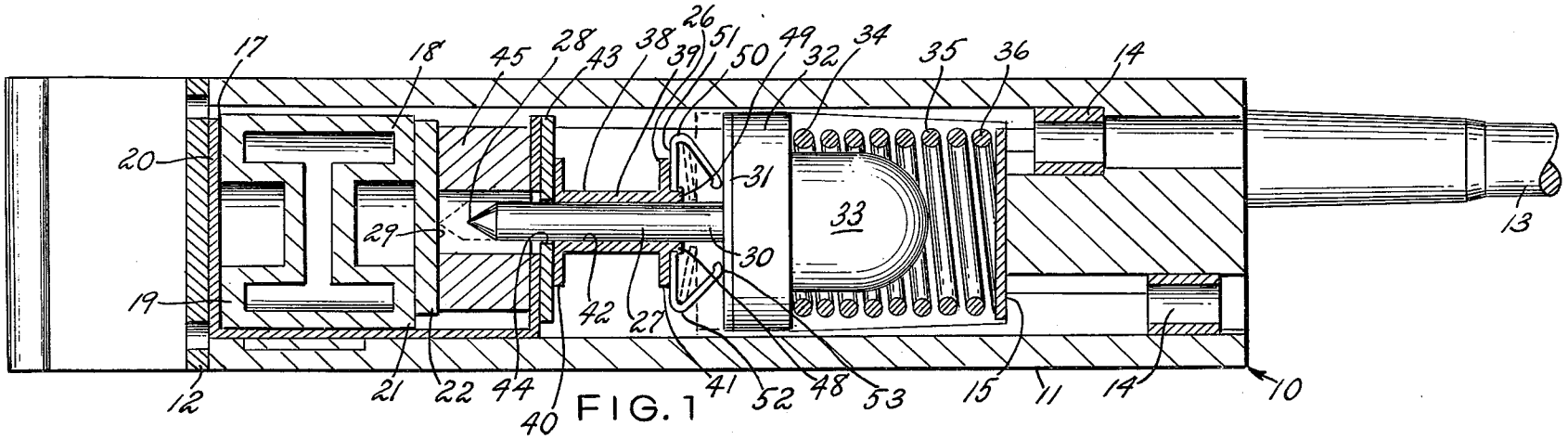
FIG. 1 is a longitudinal central sectional view of a first embodiment of the invention.

In accordance with the first embodiment of the invention, the device, generally indicated by reference character 10 includes a housing element 11 having a removable end cover 12 selectively interconnectable therewith by means known in the art. The housing element 11 mounts a grounding prong 13 of conventional configuration and a plurality of female contacts 14, normally four in number for interconnection with a known circuit board. Connecting members, one of which is indicated by reference character 15 interconnect pairs of contacts 14 for electrical conduction during normal operation.

Excess voltage protection means 17 includes a known type of gaseous discharge device 18, the left hand side 19 of which bears against a conductive member 20. The right side thereof indicated by reference character 21 communicates with a ground plane 22 interconnected to the grounding prong 13 in well known manner.

The excessive current protection means 26 is also of generally known type, including a shaft-like pin or plunger 27, a pointed end 28 of which is adapted to bear against a surface 29 of the ground plane 22. The opposite end 30 of the plunger 27 is mounted upon a conductive plate 31 forming part of a terminal member 32. The member 32 includes an enlargement 33 engaging one end 34 of a coil spring 35, the opposite end 36 thereof bearing against the contact member 15.

A cylindrical retaining member forming heat responsive means 38 includes a tubular portion 39 and first and second flanges 40 and 41, respectively. The inner surface 42 of the tubular portion 39 forms a sliding fit with the outer surface of the plunger 27, and is interconnected thereto by the presence of a thin coating of meltable solder (not shown). The flange 40 abuts an apertured plate 43 having an opening 44 through which the plunger 27 projects. An insulative collar 45, usually of ceramic material, includes a centrally disposed bore, the length of which prevents contact, under normal conditions between the plunger and the ground plane.

Disposed rightwardly of the second flange 41 is a projecting portion 48 which is headed over at 49 to retain a resiliently deformable annular contact member 50. The member 50 includes a planar base 51 from which radiate a plurality of flexible fingers 52, the free ends 53 of which contact the plate 31.

During normal operation, currents flow through the contacts 14 and connecting members 15 without hindrance. On the occurrence of an excessive voltage surge, the current will seek a path to ground potential through the spring 35, the terminal member 32, the plunger 27, and the U-shaped conductive member 20. It then passes through the gaseous discharge device 18 to the ground plane 22 and grounding prong 13. In prior art constructions, there has been a tendency to arc between the outer surface of the plunger 27 and the edge of the openings in the plate 43 and member 20.

The presence of the resiliently deformable conducting member 50 provides an additional path between the terminal member 32 and the cylindrical retaining member 38 which includes the flange 40 directly contacting the plate 43, thereby effectively eliminating any possibility of arcing, and confining such arcing to the gaseous discharge device.

Upon the occurrence of an excessive current for a substantial period of time, heat caused by excess current flow in the connecting member 15 is transmitted through the same path to heat the solder joint between the cylindrical retaining member 38 and the plunger 27, thereby permitting the pointed end 28 of the plunger 27 to contact the ground plane, as indicated in dashed lines in FIG. 1. During this movement, the member 50 is compressed to the position shown in the dashed lines, thereby offering no effective resistance to the action of the spring 35. Once this mechanism has been actuated, the device must be reset, but because current is transmitted directly to the ground plane, it is not carried by the gaseous discharge device for a period longer than that necessary to melt the solder.

In a variation of the embodiment shown in FIG. 1, and not illustrated, the cylindrical retaining member supports a heat coil of wire in series with the connecting member 15 and surrounding the area of the tubular portion 39 between the flanges 40 and 41. This type of construction results in essentially the same mode of operation, except that the conduction of heat through the heat coil results in somewhat faster operation.

Figure 2:
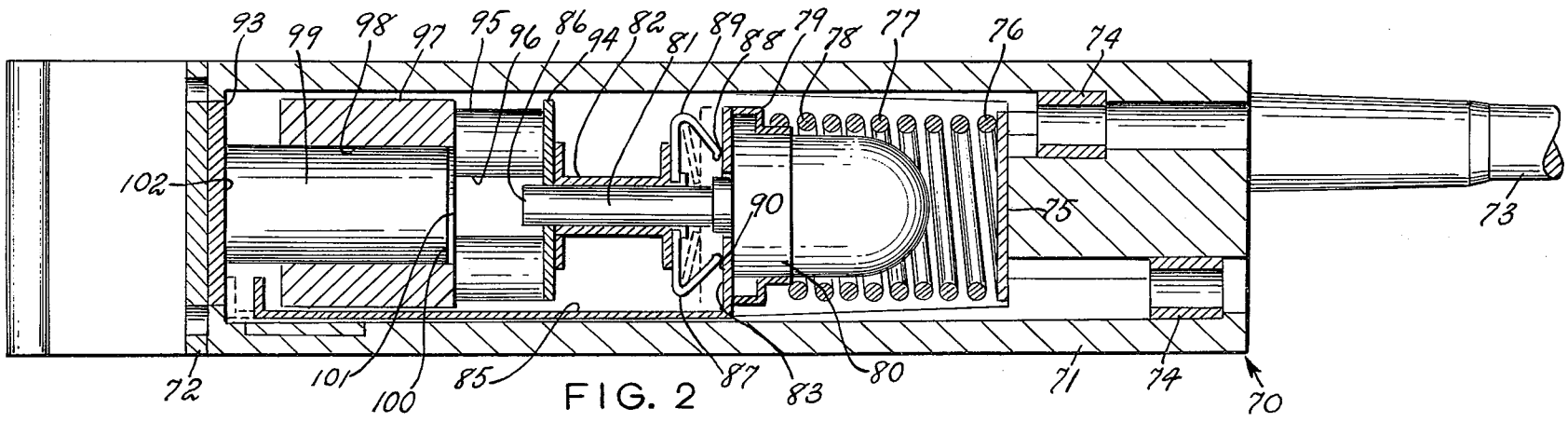
FIG. 2 is a longitudinal central sectional view of a second embodiment of the invention.

Turning now to the second embodiment of the invention, illustrated in FIG. 2 in the drawing, and generally indicated by reference character 70, the device includes a generally similar casing element 71 and cover 72 therefor. Also similar are the grounding prong 73, the contacts 74 and connecting member 75 which overlie one end 76 of the coil spring 77, the other end 78 overlying the terminal member 79.

The terminal member itself is of somewhat modified construction, including an insulative member 80 upon which the shaft member 81 is mounted, the member 81 not providing an electrically conductive function. The outer surface of the shaft member 81 engages a retaining member 82 by solder (not shown), and does not electrically communicate with the supported end 83 of a U-shaped connecting member 85. The free end 86 of the shaft 81 is blunt. The deformable member 87 corresponds to the member 50 of the first embodiment, and the free ends 88 of the deformable fingers 89 contact a surface 90 of an arm of the connecting member 85. When actuated, the connecting member 85 moves leftwardly as seen in the drawing, so that the free end shown in portion 87 thereof deashed lines contacts the ground plane 93 which is in communication with the grounding prong 73. The left hand surface of the retaining member 82 contacts a plate 94 overlying a cylindrical carbon block 95 having a centrally disposed bore 96 therein. The block 95 rests upon an insulative sleeve 97 of ceramic material having a hollow bore 98 supporting a cylindrical carbon block 99 one end 100 of which forms a spark gap 101 with the block 95, while the opposite end 102 rests upon the ground plane.

During normal operation of the second embodiment, current passes through the contacts 74 and connecting members 75. Excessive voltage is conducted through the spring 77 and terminal 79, thence through the deformable member 87, the retaining member 82, the plate 94 and carbon blocks 95 and 99 to the ground plane. Upon the occurrence of excessive current heat carried by the above members melts the solder interconnecting the shaft member 81 with the retaining member 82, and relative movement therebetween caused by the coil spring 77 brings the connecting member 85 into contact with the ground plane, causing direct conduction of the excessive currents which then by-pass the carbon blocks, and prevent high current arcing. As is the case in the first embodiment, the retaining member 82 may carry a conventional heat coil (not shown) for more rapid response.

It will be observed that in each embodiment, high currents are shorted past the arcing device provided for protection against high voltages, so that minimal, if any, damage occurs as a result of the device sustaining a high current load for an appreciable period of time. Thus, when service is restored, the protective module may be dissassembled and repaired rather than merely discarded.

I wish it to be understood that I do not consider the invention limited to the precise details of structure shown and set forth in this specification, for obvious modifications will occur to those skilled in the art to which the invention pertains.

I claim:

1. In a telephone line protective module of a type including means for conducting excessive voltage surges through an arcing device to a source of ground potential, and heat-responsive means for conducting excessive currents to said source of ground potential, the improvement comprising: means selectively providing an electrically conductive path to said source of ground potential by-passing said arcing device, upon actuation of said heat-responsive means; said means including a spring-loaded terminal member having a shaft-like plunger thereon, a relatively fixed retaining member slidably fitted relative to said plunger, said heat-responsive means interconnecting said retaining member and said plunger, and an annular compressible electrically conductive member positioned between said retaining member and a portion of said plunger to provide electrical communication therebetween, irrespective of the relative position between said plunger and said fixed retaining member.

2. Structure in accordance with claim 1, further characterized in said compressible conductor member including a planar base secured to a part of said fixed retaining member, and a plurality of radially-arranged fingers, the free ends of which resiliently contact a conductive surface of said terminal member.

3. Structure in accordance with claim 2, including a U-shaped connecting member, one end of said member being interconnected to said plunger, and an opposite end thereof being positioned to overlie a conductive member communicating with said source of ground potential to resiliently contact said last mentioned member upon actuation of heat-responsive means.

4. Structure in accordance with claim 2, including conductor means communicating with said source of ground potential, and positioned to be contacted by said plunger upon actuation of said heat-responsive means, said conductor means being positioned between said heat-responsive means and said means for conducting excessive voltage surges.

* * * * *